US008495836B2

(12) United States Patent
Lowder et al.

(10) Patent No.: US 8,495,836 B2
(45) Date of Patent: Jul. 30, 2013

(54) DOOR HARDWARE DRIVE MECHANISM WITH SENSOR

(75) Inventors: Scott B. Lowder, Orange, CT (US); Dale D. Martin, East Lyme, CT (US); Jon Hulse, Wethersfield, CT (US); Robert C. Hunt, Reno, CT (US); Arthur Limoncelli, New Haven, CT (US); Wai P. Wong, Orange, CT (US)

(73) Assignee: Sargent Manufacturing Company, New Haven, CT (US)

( * ) Notice: Subject to any disclaimer, the term of this patent is extended or adjusted under 35 U.S.C. 154(b) by 727 days.

(21) Appl. No.: 12/548,938

(22) Filed: Aug. 27, 2009

(65) Prior Publication Data

US 2011/0047874 A1 Mar. 3, 2011

(51) Int. Cl.
*E05F 15/20* (2006.01)
*E05F 15/18* (2006.01)

(52) U.S. Cl.
USPC ..... 49/394; 292/92

(58) Field of Classification Search
USPC .... 49/394; 292/92–94, 144, DIG. 65; 74/469, 74/89.23, 424.71
See application file for complete search history.

(56) References Cited

U.S. PATENT DOCUMENTS

| | | | | |
|---|---|---|---|---|
| 3,614,145 | A | 10/1971 | Zawadzki | |
| 3,722,938 | A | 3/1973 | Bauer et al. | |
| 3,730,574 | A * | 5/1973 | Zawadzki | 292/92 |
| 3,767,238 | A * | 10/1973 | Zawadzki | 292/21 |
| 3,801,144 | A * | 4/1974 | Diehl | 292/92 |
| 3,854,763 | A * | 12/1974 | Zawadzki et al. | 292/201 |
| 3,877,262 | A | 4/1975 | Williams | |
| 4,083,590 | A * | 4/1978 | Folger | 292/92 |
| 4,145,900 | A | 3/1979 | Ohno | |
| 4,167,280 | A * | 9/1979 | Godec et al. | 292/92 |
| D268,003 | S | 2/1983 | Ohno | |
| 4,384,738 | A | 5/1983 | Floyd | |
| D279,647 | S | 7/1985 | Ohno | |
| 4,961,330 | A * | 10/1990 | Evans | 70/21 |
| 4,968,070 | A * | 11/1990 | Choi | 292/92 |
| 5,033,282 | A | 7/1991 | Gartner et al. | |
| 5,085,475 | A * | 2/1992 | Austin et al. | 292/92 |
| 5,322,332 | A * | 6/1994 | Toledo et al. | 292/92 |
| 5,369,912 | A * | 12/1994 | Ginzel et al. | 49/141 |
| 5,410,301 | A | 4/1995 | Dawson et al. | |
| 5,421,178 | A * | 6/1995 | Hamel et al. | 70/283 |
| 5,531,492 | A | 7/1996 | Raskevicius | |
| 5,622,397 | A * | 4/1997 | Rice et al. | 292/259 R |

(Continued)

OTHER PUBLICATIONS

Sargent Manufacturing Company, 56-Electronic Latch Retraction Exit Device.

*Primary Examiner* — Katherine Mitchell
*Assistant Examiner* — Justin Rephann
(74) *Attorney, Agent, or Firm* — DeLio & Peterson, LLC

(57) ABSTRACT

A drive mechanism for door hardware, such as a pushbar exit device, includes a driver for moving a component of the door hardware, a controller for controlling the operation of the driver, a sensor for detecting motion of the moving component and a spring connected between the driver and the door hardware component. The spring allows the driver to move for a period of time after the component has stopped moving. The controller monitors the sensor and moves the component until the sensor indicates that the driven component has stopped moving. The sensor produces an output signal and the controller detects an inflection point in the output signal when the component stops moving while the driver is still operating.

32 Claims, 10 Drawing Sheets

U.S. PATENT DOCUMENTS 5,687,507 A * 11/1997 Beran ..... 49/340
5,694,798 A 12/1997 Nunez et al.
5,715,715 A 2/1998 Nunez
5,727,406 A 3/1998 Banducci
5,742,986 A 4/1998 Corrion et al.
5,765,884 A 6/1998 Armbruster
5,864,134 A * 1/1999 Burgess ..... 250/221
5,865,049 A 2/1999 Friedrich et al.
5,892,443 A 4/1999 Friedrich
5,898,366 A 4/1999 Brown et al.
5,927,765 A * 7/1999 Austin et al. ..... 292/92
5,966,784 A 10/1999 Arbogast et al.
6,000,733 A * 12/1999 Linder ..... 292/92
6,022,056 A 2/2000 Cope et al.
6,102,451 A * 8/2000 Merryman ..... 292/92
6,104,594 A 8/2000 Frolov et al.
6,145,897 A * 11/2000 Locher ..... 292/92
6,175,304 B1 1/2001 Becker
6,189,939 B1 2/2001 Zehrung
6,329,779 B1 * 12/2001 Pimley et al. ..... 318/445
6,386,597 B1 5/2002 Walsh, III
6,394,508 B1 5/2002 Zehrung
6,417,637 B2 * 7/2002 Fitzgibbon et al. ..... 318/459
6,565,130 B1 * 5/2003 Walsh, III ..... 292/92
6,640,494 B2 * 11/2003 Hormann ..... 49/31
6,655,180 B2 12/2003 Gokcebay et al.
6,734,648 B2 * 5/2004 Fukumura et al. ..... 318/468
6,769,723 B2 8/2004 Cohrs et al.
6,799,669 B2 * 10/2004 Fukumura et al. ..... 192/105 R
6,851,291 B2 2/2005 Nunez
6,945,571 B2 * 9/2005 Lin ..... 292/92
6,953,211 B2 * 10/2005 Di Vinadio ..... 292/296
6,980,117 B1 * 12/2005 Kirkland et al. ..... 340/686.1
7,158,043 B2 * 1/2007 Kirkland et al. ..... 340/686.1
7,204,050 B2 * 4/2007 Molokotos et al. ..... 40/570
7,339,336 B2 * 3/2008 Gregori ..... 318/282
7,469,942 B2 * 12/2008 Whitaker et al. ..... 292/92
7,484,777 B2 * 2/2009 Condo et al. ..... 292/92
7,712,800 B2 * 5/2010 Peng ..... 292/92
7,748,757 B2 * 7/2010 Shen ..... 292/92
7,780,204 B2 * 8/2010 Garneau et al. ..... 292/144
7,832,778 B2 * 11/2010 Whitaker et al. ..... 292/92
7,862,091 B2 * 1/2011 Escobar ..... 292/93
7,883,123 B2 * 2/2011 Condo et al. ..... 292/92
7,887,107 B2 * 2/2011 Shen ..... 292/92
7,905,522 B1 * 3/2011 Picard ..... 292/92
8,070,192 B2 * 12/2011 Tien ..... 292/92
8,109,038 B2 * 2/2012 Houser et al. ..... 49/345
2002/0092237 A1 * 7/2002 Hebda ..... 49/339
2002/0105191 A1 * 8/2002 Surko, Jr. ..... 292/92
2002/0153731 A1 * 10/2002 O'Brien, II ..... 292/92
2002/0153732 A1 * 10/2002 O'Brien, II ..... 292/93
2004/0041411 A1 * 3/2004 Cohrs et al. ..... 292/92
2004/0130285 A1 * 7/2004 Le Gallo ..... 318/466
2004/0227353 A1 11/2004 Cohrs et al.
2005/0039863 A1 * 2/2005 Bruno ..... 160/130
2005/0108944 A1 * 5/2005 Gregori ..... 49/31
2005/0184531 A1 * 8/2005 Lin ..... 292/92
2005/0261804 A1 11/2005 Doty et al.
2006/0081079 A1 * 4/2006 Jaecklin et al. ..... 74/89.23
2006/0082162 A1 * 4/2006 Escobar ..... 292/144
2006/0150511 A1 * 7/2006 Parsadayan ..... 49/29
2007/0273158 A1 * 11/2007 Berger ..... 292/92
2008/0012350 A1 * 1/2008 Condo et al. ..... 292/92
2009/0064735 A1 3/2009 Hartmann et al.
2009/0079204 A1 * 3/2009 Whitaker et al. ..... 292/93
2009/0127869 A1 * 5/2009 Condo et al. ..... 292/92
2010/0007154 A1 * 1/2010 Schacht ..... 292/92
2010/0026012 A1 * 2/2010 Lin ..... 292/92
2010/0045053 A1 * 2/2010 Dye et al. ..... 292/201
2010/0139429 A1 * 6/2010 Ku ..... 74/89.37
2011/0290050 A1 * 12/2011 Kummer et al. ..... 74/89.37

* cited by examiner

DOOR HARDWARE DRIVE MECHANISM WITH SENSOR

BACKGROUND OF THE INVENTION

1. Field of the Invention

This invention relates to drive mechanisms for door hardware, such as drive mechanisms for retracting the pushbar of an exit device or remotely locking a door lock. More specifically, the present invention relates to drive mechanisms that include a sensor for detecting motion of the door hardware component being driven.

2. Description of Related Art

Door hardware, such as exit devices, mortise locks and bored locks, typically include one or more elements that move between two positions, such as a retracted position and an extended position. For example, a pushbar exit device includes a pushbar that moves inward to retract a latchbolt from a strike in a doorframe and outward to extend the latchbolt. Lock mechanisms include a handle, a latchbolt and other locking elements that may be driven between two alternative positions. The moving lock component may be a locking element that locks and unlocks the door or it may be a latchbolt that latches and unlatches the door, etc.

Where it is desired to operate the door hardware remotely, the drive mechanism typically includes a driver that is electrically powered. The driver may be a conventional DC or AC motor, a linear actuator, a stepping motor or any other known device for providing mechanical motion from electrical power. In a typical design, the door hardware component is spring biased towards a first default position and the driver acts against the spring force to move the driven component towards the second position. When the driver is turned off, the spring returns the moving component to the default first position.

For convenience, the present invention will be described in the context of an exit device where the moving door hardware component is a pushbar mounted on a pair of rocker arms in a conventional parallelogram linkage mount. The pushbar is spring-biased towards an outwardly extended position and can be driven or manually pressed to the inward position to open the door. The driver is a linear actuator that includes a stepping motor and a threaded output shaft. When the driver is operated, it pulls on one of the rocker arms and moves the pushbar in towards the door against the spring biasing force. The pushbar, in turn, retracts a latchbolt from a strike in the door and unlatches the door.

It should be understood, however, that the present invention may be used in other types of door hardware, including mortise locks and cylindrical or bored locks and may be used wherever a door hardware component is driven between two alternative positions.

Electrically operated exit devices of the type described herein are often used in schools or public buildings where they are opened and closed on a fixed time schedule at the start and end of the day. Remote unlocking and opening of exit devices may also be desired for keyboard access to improve wheelchair access or for control by a remotely located security guard.

Conventional electrically operated door hardware has typically mechanically connected the driver directly to the moving component. When the driver is commanded to move, the mechanical output of the driver directly moves the door hardware component to the desired position. A difficulty with this design arises when the door hardware component being driven is blocked and prevented from moving.

For example, where the driver includes a stepping motor and the pushbar is temporarily blocked, the stepping motor may slip and fail to move when commanded by the controller. The controller, however, may believe that the door component has been moved. As a result, the driver fails to move the component to the correct final position, which may leave the door locked when it should be unlocked.

To resolve this temporary blockage condition, it may be necessary to completely reset the entire door locking system. Resetting all door hardware in a large system, such as in a school where multiple doors are under common control, is undesirable as it disrupts access to the entire building. On the other hand, individually resetting a single door each time this occurs is time consuming and expensive. Someone must be sent to reset the individual door each time this temporary condition occurs. A system that detects temporary blockages and automatically resets would provide improved performance.

Direct drive designs of the type described above typically drive from a known starting position (set by the default, released, spring-biased, outward position of the driven component) to a final position a predetermined driven distance away from the starting point. Attempting to reach a final position by driving a known distance from a starting position can be problematical. In some cases the desired final position is not known until the product is installed. In other cases, wear may change the desired final position. Alternatively, temporary blockages, motor slippage and the like may prevent the component from reaching the desired final position, even though the controller believes the final position has been reached.

Another approach is to place a single sensor at the final position to detect arrival of the component at the final position. This can also be problematical, as the desired final position may change for the reasons described above. A design that automatically detects that it has arrived at a desired final position would be desirable, even where the final position changes over time or in different installations.

A related problem in conventional designs is mechanical shock sensitivity. If door hardware is subjected to a mechanical shock, as occurs when an open door slams closed in a windstorm, some drivers, such as those that include a stepping motor, may completely release. This release is caused when the mechanical load imposed by the shock exceeds the holding force supplied by the stepping motor. When this happens, the controller loses track of the location of the moving door hardware component, causing incorrect operation. A system that reduces mechanical shock to reduce errors of this type would also provide improved performance.

Another desirable feature would be a system that automatically calibrates itself so that the system automatically adapts to different installations, automatically adjusts for wear, compensates for some errors in manufacturing and/or can be used in different designs of door hardware without modification.

SUMMARY OF THE INVENTION

Broadly stated, a drive mechanism for door hardware has been invented wherein a controller moves a component of the door hardware towards a desired position by electrically commanding a driver, such as a stepping motor of a linear actuator, to operate. The controller monitors a sensor that detects motion of the component being driven. The driver is mechanically connected to the driven door hardware component through a spring, which allows the driver to move without also moving the door hardware component. When the door hardware component reaches the limit of its motion or motion of the component is otherwise blocked by interference or excess friction, the signal from the sensor indicates to the controller that the component has stopped moving while the driver is still operating.

By detecting that the door hardware component has stopped moving, even though the driver is still moving, the controller knows that a limit has been reached and stops further motion of the driver. The location of this limit may change in different installations, over time due to wear or in different products using the same drive mechanism. In each case, the correct final destination is identified despite variations in the location of that destination.

In various other aspects of the design, the location of the final destination can be compared to the location in previous cycles of operation to identify temporary blockages and reset/recycle the drive mechanism.

In a first aspect of the drive mechanism, a driver is operatively connected to move a door hardware component, a controller is electrically connected to control the driver and move the door hardware component and a sensor is connected to the controller and mounted to detect motion of the door hardware component.

The driver is connected to the door hardware component through a spring or similar resilient connection that allows the driver to move without moving the door hardware component. The controller monitors the sensor and operates the driver to move the door hardware component at least until the sensor indicates that motion of the door hardware component has stopped.

In another aspect of the drive mechanism, the sensor is a Hall effect sensor and the drive mechanism includes a magnet. The sensor detects motion of the door hardware component by detecting relative motion between the Hall effect sensor and the magnet. In the preferred design, the drive mechanism includes a circuit board, the magnet is mounted on the moving door hardware component (or a linkage connected thereto), and the Hall effect sensor is mounted on the circuit board. This permits the electrical components requiring wired connections to be stationary and the moving part of the sensor requiring no electrical connections (the magnet) to be monitored by the controller without contact therewith.

In a further aspect of the drive mechanism, the controller initially operates the driver, to ensure the door hardware component begins to move, prior to determining from the sensor when motion of the door hardware component has stopped. This ensures that any initial slack is taken up and that any initial friction is overcome before the controller attempts to detect that motion of the door hardware component has stopped.

In still another aspect of the drive mechanism, the driver has a maximum driver force that can be exerted by the driver to the spring, the spring has a maximum spring force that can be exerted by the spring when the spring is fully compressed, and the maximum spring force is greater than the maximum driver force. This ensures that the spring has not fully compressed even when the driver is exerting the maximum possible force.

In yet another aspect of the drive mechanism, the sensor provides a substantially continuously changing sensor output signal as the door hardware component is driven by the driver through the connection to the spring. In this embodiment, the sensor provides a substantially unchanging sensor output signal when the door hardware component stops moving, even when the driver continues to move. The controller monitors the sensor output signal to detect an inflection point indicating a transition from the substantially continuously changing sensor output signal to the substantially unchanging sensor output signal. Preferably the controller monitors the slope of the sensor output signal.

In still another aspect of the drive mechanism, the controller operates the driver and compresses the spring a predetermined amount after the controller has passed the inflection point. In one aspect, the driver includes a stepping motor and the controller sends a predetermined number of pulses to reach the desired predetermined compression. In another aspect, the predetermined amount of spring compression is selected to minimize the spring compression while also ensuring that the door hardware component has reached a desired location corresponding to the inflection point.

In a further aspect, the controller operates the driver to compress the spring after the controller detects the inflection point and then operates the driver in a reverse direction to reduce compression of the spring. This design allows a relatively high level of force to be temporarily applied to the moving component, then this force is reduced before the driver enters a holding state. This avoids detection of "false" inflection points corresponding to points where the moving door hardware component stops moving only briefly, then begins to move again as the force applied by the spring increases.

In another aspect, the controller stores a first parameter corresponding to detection of the inflection point and updates this first parameter for each operating cycle of the drive mechanism. The controller compares the stored first parameter for a previous operating cycle to a second parameter corresponding to a second detection of the inflection point for a second current operating cycle. When the two parameters differ by more than a predetermined difference, the controller recycles the drive mechanism and begins a third operating cycle. This design also avoids detection of false inflection points, which may correspond to a temporary blockage of the moving door hardware component.

The drive mechanism is able to automatically compensate and adjust for wear using this design because normal changes between each operating cycle due to wear are less than the predetermined difference permitted during the comparison. Only a significant difference resulting from a blockage causes the reset and recycle, while slow changes due to wear are incorporated into the parameter stored for each cycle and used for the next comparison.

The stored parameters and predetermined difference may be based upon a comparison of digital signals, analog voltages received from the sensor, the number of pulses sent by the controller to a stepping motor in the driver, or upon any parameter that corresponds to the point where the component has stopped moving while still being driven by the driver.

In a related aspect, the stored parameter for each operating cycle corresponds to the distance the controller has moved the door hardware component before detecting the inflection point. The detection of the sensor inflection point allows the controller to include a self-adjusting calibration routine at startup. The self-adjusting calibration routine preferably includes repeating multiple operating cycles, detecting an inflection point for each cycle and storing a parameter corresponding to a normal operating cycle and the inflection point therefor.

In another aspect of the drive mechanism, the controller detects the inflection point by calculating a slope for the changing sensor output signal and detecting a change in the calculated slope. The controller may calculate the slope of the changing sensor output signal by using a sliding window including multiple detections of the changing sensor output signal.

In a preferred design of the drive mechanism, the controller enters the self-adjusting calibration routine when power is initially applied thereto. This design allows the same drive mechanism design to be used in different door hardware devices having different mechanical limits for different door hardware components. The initial self-adjusting calibration routine causes the drive mechanism to identify the inflection point corresponding to the new mechanical limits and to store a parameter corresponding thereto.

In another aspect, the drive mechanism includes a spring carriage with the spring mounted therein. The spring carriage is slidably mounted to the drive mechanism. The spring is preferably held in a compressed state inside the spring carriage, and a first end of the spring is fixed relative to the spring carriage, while the second end of the spring is movable relative to the spring carriage. The spring carriage is connected to the door hardware component and the driver is connected to the second end of the spring.

When the driver is operated by the controller it drives the spring, which drives the spring carriage, which, in turn, drives the door hardware component as it slides. As the door hardware reaches a limit, it stops and the driver continues to operate, compressing the spring. This produces an inflection point as the driver and one end of the spring move, while the other end of the spring, the spring carriage and the door hardware component have stopped moving.

This design also has the advantage that the door hardware component is resiliently connected to the driver, thereby reducing transmission of shock loads to the driver and reducing shock sensitivity of the complete system.

In still another aspect, a spring pin is connected to the movable end of the spring and the spring carriage includes opposed sides, each side having a corresponding spring pin slot. The spring pin extends between the opposed sides of the spring carriage and slides within the spring pin slots as the spring is compressed.

In yet another aspect, the drive mechanism includes a support base having a pair of upstanding flanges and the flanges are spaced apart to receive the spring carriage and allow the spring carriage to slide therebetween. The flanges act as guides on opposite sides of the sliding spring carriage.

In a further aspect, the drive mechanism includes a spring carriage pin and each of the upstanding flanges has a corresponding spring carriage slot formed therein. The spring carriage pin is fixed to, and moves with, the spring carriage. The spring carriage pin extends between the opposed flanges, is captured in, and slides in the spring carriage slots.

In a preferred design, the door hardware component is connected to the spring carriage pin. When the door hardware component is a rocker arm for a pushbar exit device, the rocker arm may be connected to the spring carriage pin with a linkage that permits manual operation of the pushbar.

In a further aspect of the drive mechanism, the driver includes a shaft extending through the spring. The shaft is connected at the far end of the spring and the spring is held on the shaft.

In another aspect of the drive mechanism, the moving door hardware component is biased towards a first position, preferably by a spring capable of moving the door hardware component back to the first position when released. The controller operates the driver to move the door hardware component away from the first position towards a second position. In this design, the controller may simply remove power from the driver and thereby permit the door hardware component to return from the second position to the first position.

However, this design may cause an audible noise as the door hardware component is released. Noise made during door hardware operation is objectionable in high quality door hardware. To prevent the hardware from making this noise, the preferred design uses the controller to actively drive the door hardware component in reverse—away from the second position towards the first position with a residue of remaining power.

The residue of remaining power is typically found in filter capacitors for the power supply of the driver. The controller removes power and uses the remaining stored residue of power to provide a controlled motion away from the second position towards the first position. Typically, there is insufficient power remaining for the driver to completely return the door hardware component to the first position under power. The final part of the return motion, after the stored residue of power has been depleted, is provided by the biasing spring. Nonetheless, this controlled or "soft" release action greatly reduces the noise produced at the initial release when the biasing spring for the door hardware component and the spring connecting the driver to the component are maximally compressed.

In a further aspect of the drive mechanism, the drive mechanism is self-adjusting each time power is applied to the controller. The self-adjusting operation is preferably achieved by the controller cycling the driver through multiple operating cycles to detect a normal inflection point for the door hardware component being driven. The normal inflection point corresponds to a normal limit of motion of the door hardware component being driven.

In still another aspect of the drive mechanism, the sensor includes a magnet and the controller initially detects an orientation of the magnet and adjusts for reversed installation of the magnet, which may be intentional in different designs, or the result of a manufacturing error.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-10 of the drawings in which like numerals refer to like features of the invention.

Figure 1:
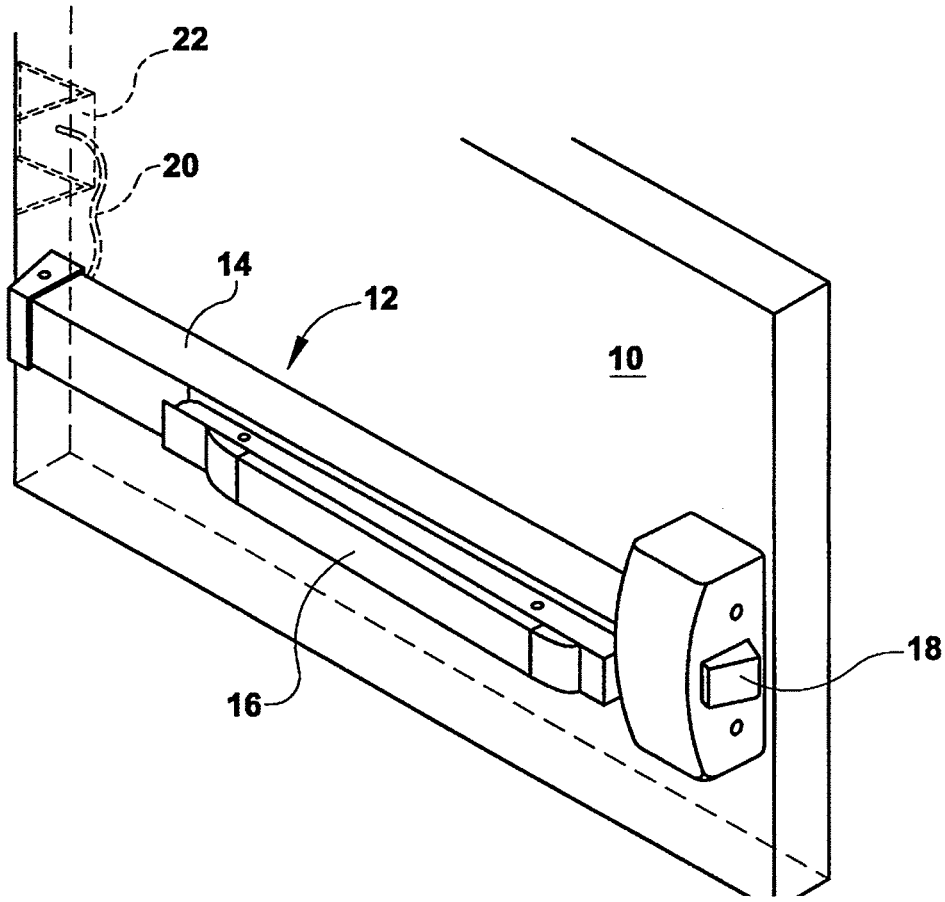
FIG. 1 is a perspective view from the upper right of door hardware comprising a pushbar exit device containing a drive mechanism for retracting the pushbar constructed according to the present invention. The exit device is shown mounted on a door and an electric hinge with associated power wiring is shown in phantom.
Figure 2:
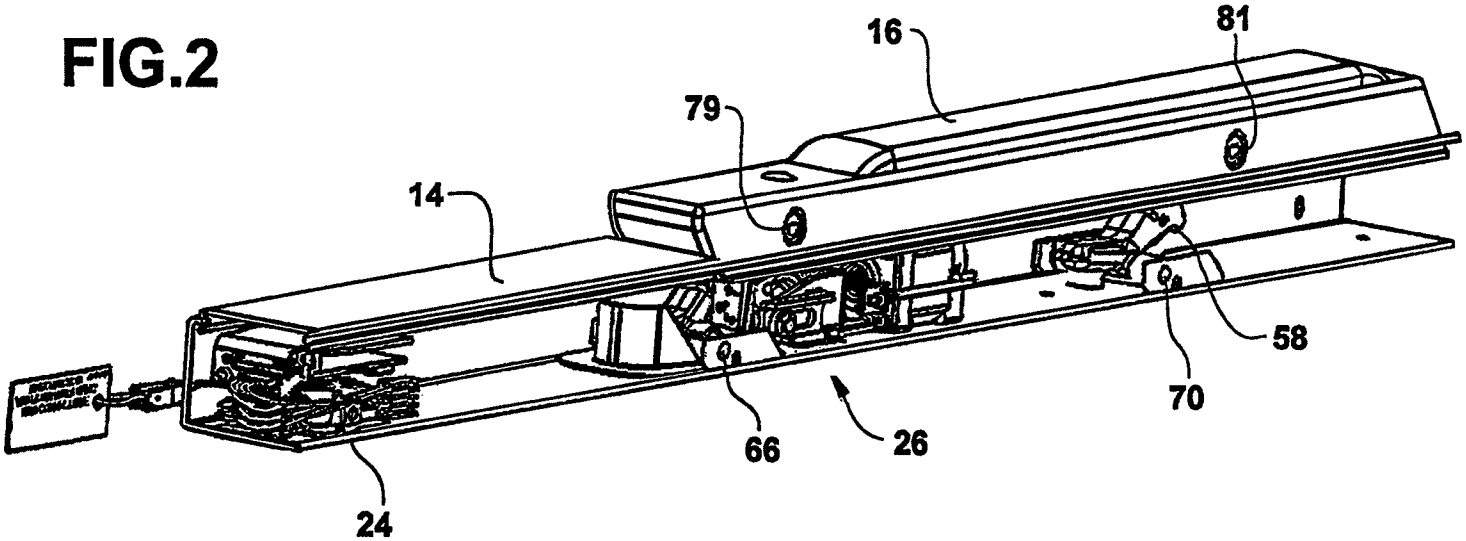
FIG. 2 is a perspective view from the lower left of a portion of the pushbar exit device in FIG. 1. An end cap has been removed and a sidewall of the exit device has been cut away to show the drive mechanism of the present invention and other internal components of the pushbar exit device.

Referring to FIG. 1, a door 10 is provided with a pushbar exit device 12 having a body 14, a pushbar 16 and a latchbolt 18. Referring to FIG. 2, a drive mechanism according to the invention is located within the body 14 of the exit device and is electrically connected to power and a control system with wire 20 through electric door hinge 22. The drive mechanism includes a controller 24 and a drive mechanism assembly 26.

The controller is preferably a microcontroller with integrated inputs, outputs, memory and a central processing unit, although other conventional control systems may be used. The controller unit is also provided with power connections and electronic controls for a linear actuator 28 found in the drive mechanism assembly 26. In the preferred design, the electronics comprising the controller 24 are separated from the drive mechanism assembly 26, however, in other embodiments, they may be integrated into a single assembly.

Figure 3:
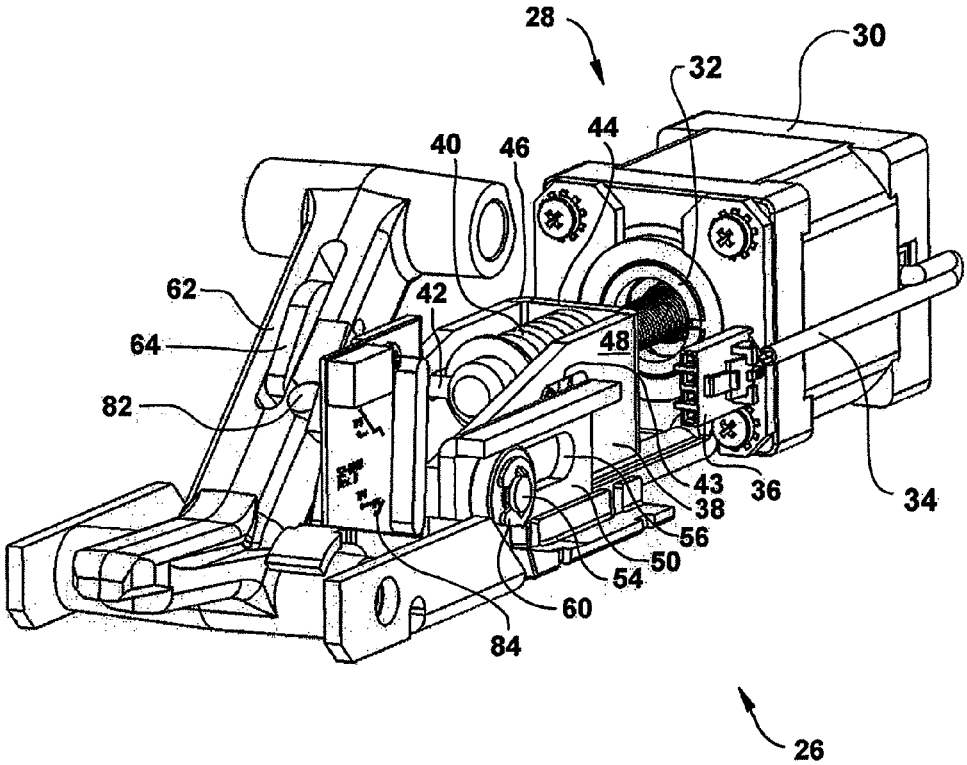
FIG. 3 is a perspective view of a portion of the drive mechanism seen in FIG. 2 comprising an assembly including mechanical components, a linear actuator and a sensor. The controller located in the end of the pushbar in FIG. 2 is not shown. The perspective view is taken from the same angle as in FIG. 2.
Figure 4:
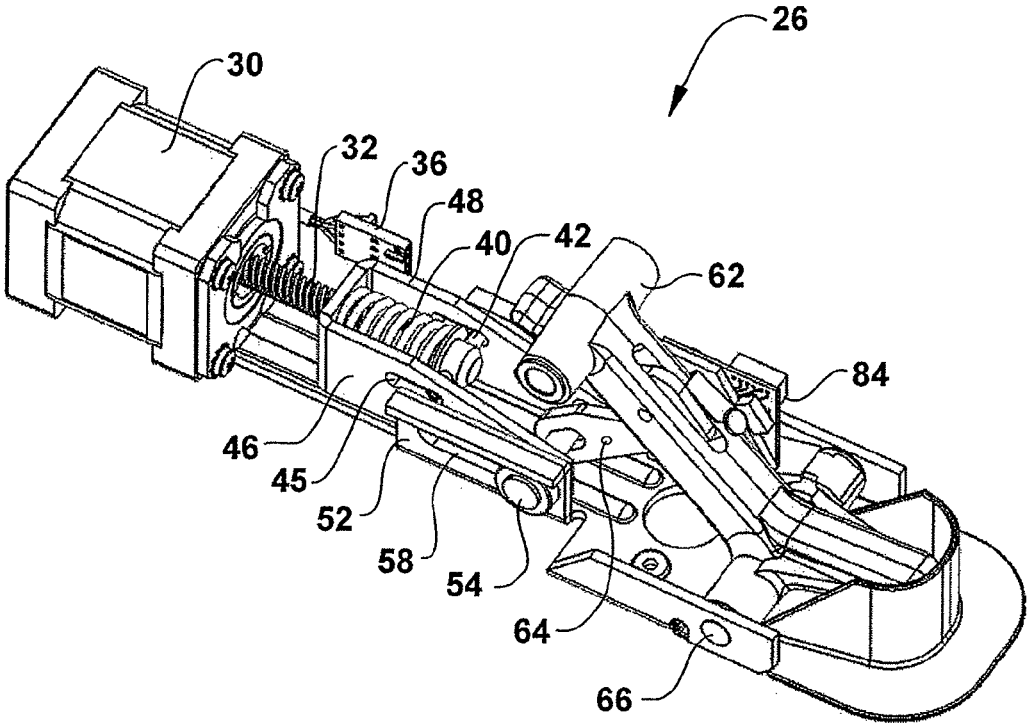
FIG. 4 is an additional perspective view of the drive mechanism assembly seen in FIG. 2 showing the opposite side thereof.

Referring also to FIGS. 3 and 4, the drive mechanism assembly 26 includes the linear actuator 28, having a stepping motor 30 and a threaded output shaft 32. The stepping motor 30 is electrically connected to the controller 24 by means of wire 34 and electrical connector 36. The controller 24 sends pulses to the stepping motor in the linear actuator, which drives an internally threaded nut located inside the linear actuator.

The internally threaded nut is held in a horizontally fixed position relative to the stepping motor, but is free to be rotated by the stepping motor. The internal threads of the nut engage the external threads of the output shaft 32. As the nut is rotated in a first direction by the stepping motor, the output shaft 32 extends relative to the stepping motor 30. As the nut is rotated in the opposite direction under the commands of the controller, the output shaft 32 is retracted.

The nut in the stepper motor 30 may also be magnetically held in position by the controller to prevent the output shaft from moving or it may be released to freewheel, which allows the output shaft to move in or out in response to a force applied axially to the output shaft.

The driver is preferably a linear actuator using a stepping motor because it is well suited to accurate digital position control by a digital controller. However, other drivers may also be used, including DC and AC motors, linear motors, stepping devices and the like.

Figure 5:
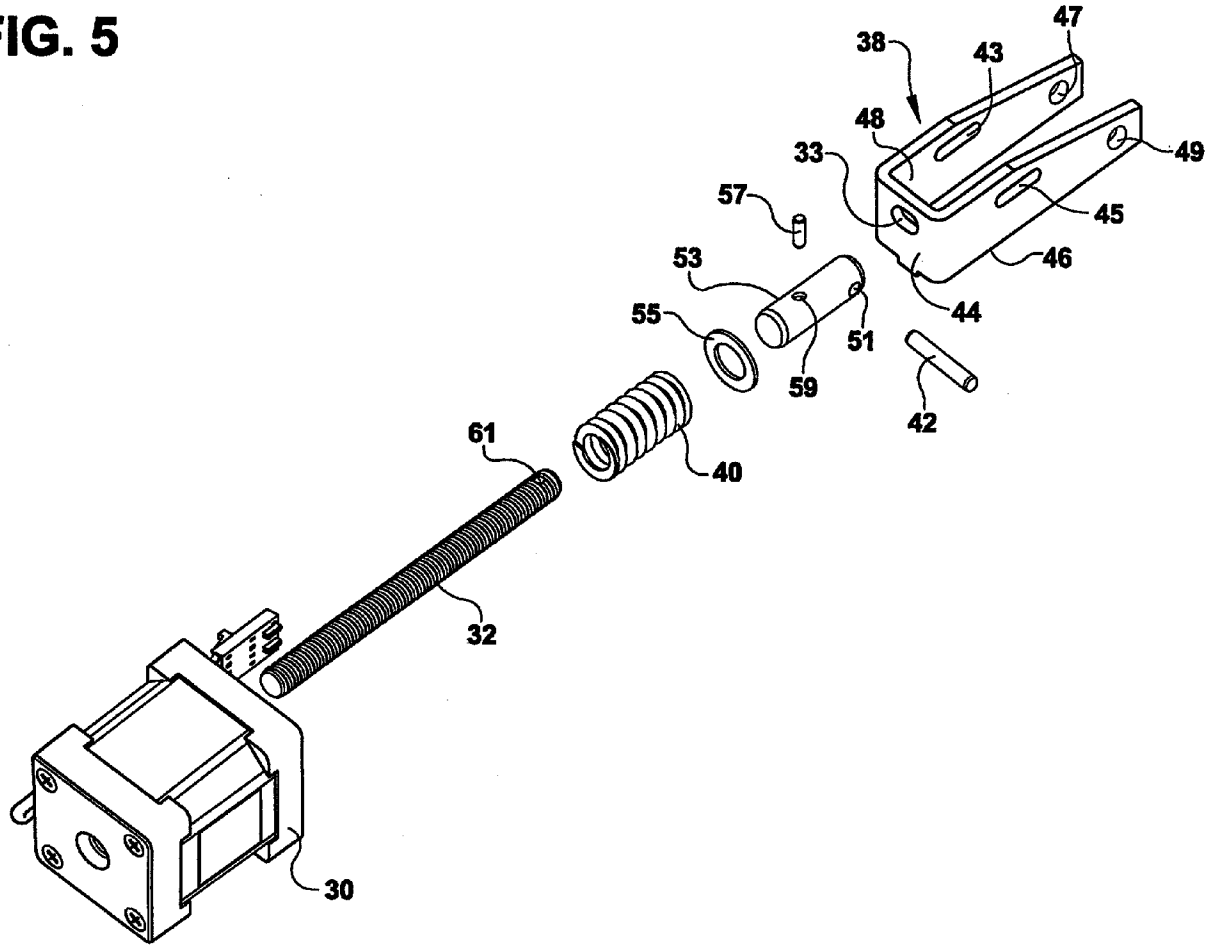
FIG. 5 is a fragmentary exploded view showing components of the drive mechanism assembly seen in FIGS. 2 and 3. The principal components shown include the stepping motor and threaded motor shaft forming the linear actuator and the spring, spring pin and spring carriage.

Output shaft 32 extends through an opening 33 in wall 44 of spring carriage 38 and through spring 40 (see FIG. 5). The end of the output shaft 32 connects to the far end of the spring 40 by means of a spring cap 53 and spring pin 42. Spring 40 is always held in compression between wall 44 of the spring carriage 38 and the spring pin 42.

Wall 44 of the spring carriage 38 is located between opposed sidewalls 46 and 48 of the spring carriage. These three walls define an interior space of the spring carriage that holds the spring 40. Spring 40 is also held in place by the output shaft 32 which passes through the center of spring 40.

The spring pin 42 is held in opposed spring pin slots 43 and 45 formed in the opposed sidewalls 46 and 48 of the spring carriage.

Provided that the spring carriage 38 is unobstructed, the spring carriage slides towards and away from the stepping motor 30 under the command of controller 24 as the threaded shaft 32 of the linear actuator is driven towards and away from the motor.

The sidewalls 46 and 48 of the spring carriage 38 are located between opposed upstanding flanges 50 and 52 on the support base of the drive assembly. The distance between the outer surfaces of the walls 46 and 48 of the spring carriage is less than the distance between the inner surfaces of the upstanding flanges 50 and 52 so that the spring carriage is guided between the flanges 50 and 52 as it slides.

The sliding motion of the spring carriage 38 is also controlled by a spring carriage pin 54 that slides within a pair of spring carriage slots 56 and 58 formed in the opposed flanges 50, 52, respectively. A C-ring 60 is used to hold the spring carriage pin 54 in slots 56, 58.

The spring carriage pin 54 passes through correspondingly-sized holes in the sidewalls 46 and 48 of the spring carriage so that the spring carriage pin always remains fixed relative to the spring carriage. As the spring carriage is driven through the spring 40, the spring carriage pin always moves with it. As can be seen most clearly in FIG. 4, the spring carriage pin is connected to a moving component 62 of the door hardware through linkage 64. The linkage 64 engages the spring carriage pin 54 on one end and the moving component 62 at its opposite end.

Referring to FIG. 5, an exploded view shows the details of the linear driver 28, spring 40 and spring carriage 38. Stepping motor 30 drives the output shaft 32 in the manner described above. The output shaft 32 extends through opening 33 in wall 44 into the interior of the spring carriage 38. The opposed sidewalls 46, 48 of the spring carriage 38 have spring slots 43, 45 formed therein.

Holes 47 and 49 are also formed in the opposed sidewalls 46, 48. The holes 47, 49 receive the spring carriage pin 54 and prevent it from moving relative to the spring carriage. The spring carriage pin 54 connects the spring carriage to the linkage 64, which drives the pushbar via the parallelogram rocker arm linkage.

Spring 40 is mounted inside spring carriage 38 and surrounds the output shaft 32 and a portion of spring cap 53. The spring 40 is held in an initially compressed state between wall 44 and spring pin 42. The spring pin 42 slides in spring pin slots 43 and 45. Spring pin 42 passes through opening 51 in the spring cap 53 so that motion of the spring cap 53 relative to the spring carriage is limited by the spring slots 43 and 45.

The far end of spring 40 is prevented from moving beyond the spring pin 42 by washer 55, which forms a seat for one end (the far end relative to motor 30) of spring 40. The spring cap 53 is pinned to the end of output shaft 32 with pin 57 that engages opening 59 in the spring cap and opening 61 in the output shaft.

Referring to FIGS. 2 and 6-9, the moving component 62 illustrated is one of two rocker arms for the pushbar 16 of the illustrated pushbar exit device. Rocker arm 62 pivots on lower rocker arm pivot pin 66. Rocker arm 68 pivots on lower rocker arm pivot pin 70. The two rocker arms 62, 68 are pivoted at the upper end to the pushbar 16 with respective upper rocker arm pivot pins 79, 81 to form a parallelogram linkage between the body of the exit device and the pushbar 16. The parallelogram linkage acts to keep the pushbar 16 always parallel to the body of the exit device as it moves towards and away from the body of the exit device.

Although the illustrated embodiment connects the driver through a linkage to a rocker arm in an exit device, the invention may be used with many other types of moving door hardware components.

When the pushbar 16 moves towards the body of the exit device (to the retracted position) it retracts the latchbolt 18 from a strike in the doorframe and allows the door 10 to open. As may be seen best in FIGS. 6-9, the linkage 64 is connected to the rocker arm 62 with a hook opening 74 at one end thereof and a further enlarged opening 76 at the opposite end. The enlarged opening 76 connects linkage 64 to the spring carriage pin.

Figure 6:
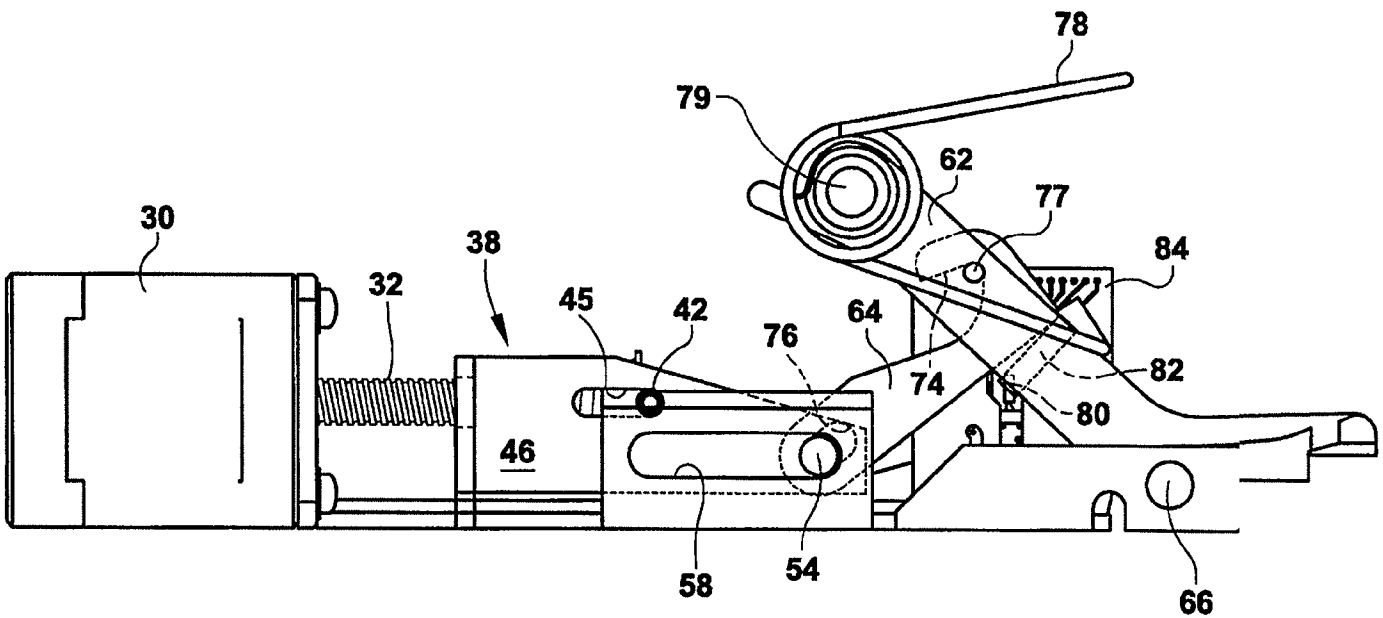
FIG. 6 is a side elevational view of the drive mechanism assembly seen in FIGS. 2 and 3. The position sensor comprising a Hall effect sensor mounted on a circuit board and a magnet mounted on a rocker arm that moves relative to the circuit board are shown. The drive mechanism is illustrated in the mechanically and electrically fully extended state where the pushbar and latchbolt of the exit device in FIG. 1 are extended outward, allowing the door to latch closed.
Figure 7:
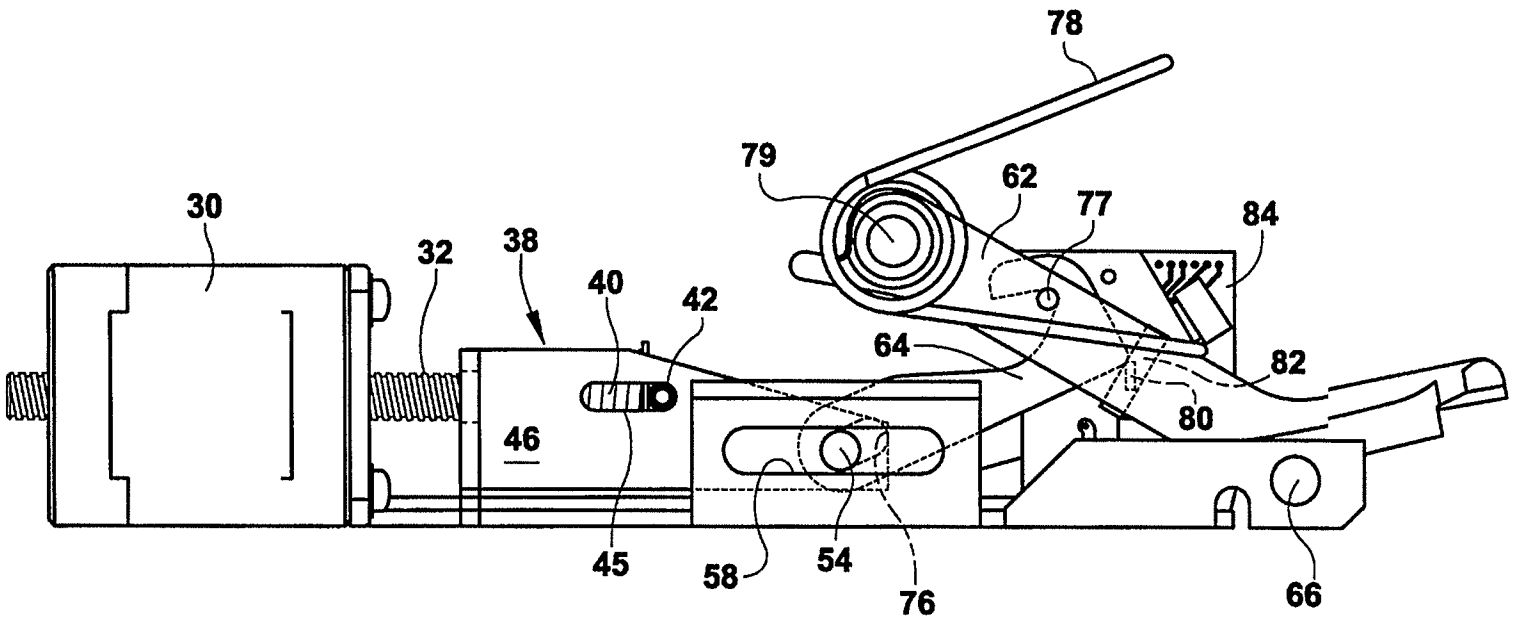
FIG. 7 is a side elevational view of the drive mechanism assembly corresponding to FIG. 6 except that the drive mechanism assembly is shown in the partially electrically retracted state. The linear actuator of FIG. 5 is retracting the spring carriage and has partially retracted the pushbar and latchbolt of the exit device in FIG. 1. The spring inside the spring carriage is not yet compressed.
Figure 8:
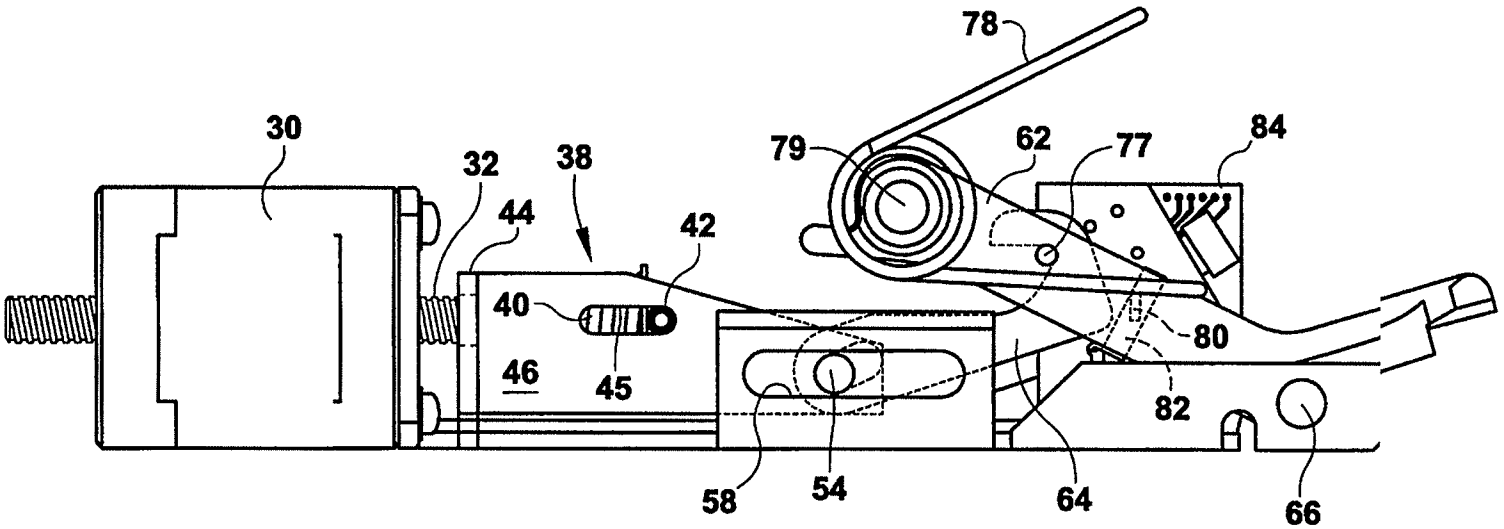
FIG. 8 is a side elevational view of the drive mechanism assembly corresponding to FIGS. 6 and 7 except that the drive mechanism is shown in the fully electrically retracted state. The linear actuator has fully retracted the spring carriage seen in FIG. 5, as well as the pushbar and latchbolt of the exit device seen in FIG. 1. The spring in the spring carriage is partially compressed.

When the pushbar is not being manually pressed inward, linkage 64 is held in tension, as in FIGS. 6-8. When the pushbar is manually operated, however, the slack provided by hook opening 74 and opening 76 at opposite ends of the linkage allow the pushbar 16 to be manually operated without moving the spring carriage and without affecting the linear actuator 28 (see FIG. 9).

Because the pushbar is biased towards the extended position (see spring 78 in FIG. 6), the hook and enlarged opening connections at the ends of the linkage do not affect operation unless the pushbar is being manually operated.

One advantage of the spring connection of this invention is the reduction in transmitted force between the door hardware component being driven and the driver that is moving it. This reduction in transmitted force reduces the likelihood that the driver will inadvertently release when the door is subjected to shock. It also reduces wear and tear on the driver.

Shocks of relatively large magnitude are often encountered by door hardware. For example, when released in a wind, a door can swing shut with great force. If the driver releases as a result of this type of mechanical shock, the pushbar returns to the extended outward position and the door latches closed, preventing further access through a door that should be open.

Although mechanical shock reduction is highly desirable, other significant advantages to the use of the spring 40 to form a resilient connection are described below. These additional advantages arise from the fact that the spring 40 allows the driver to continue to move after the door hardware component has stopped moving and this differential motion can be detected to identify when the driven component has reached a desired limit.

The resilient spring connection allows the driver to move the door hardware component to a mechanical limit stop. With a rigid connection between the moving component and the driver, as in prior art designs, the driver must stop moving before the component reaches a mechanical limit. The driver drives the driven component to a desired location known in advance or set during installation.

With the resilient spring connection of this invention, the driver can attempt to drive the door hardware component beyond an expected mechanical limit. When the mechanical limit is reached, the spring pin 42 will begin to move relative to the spring carriage and the spring 40 will be compressed further.

When coupled with a sensor to monitor when the driven component stops moving, the controller can detect that the mechanical limit has been reached or that the driven component is being blocked. In the preferred design, the complete sensor mechanism includes a Hall-effect sensor 80 and a magnet 82. The Hall-effect sensor 80 is preferably mounted on circuit board 84 so that it is in close proximity to magnet 82, which is mounted to the moving rocker arm 62.

The Hall-effect sensor 80 produces an analog output voltage that corresponds to the strength and polarity of the magnetic field produced by the adjacent magnet 82. The magnet 82 is mounted so that the north and south poles are at its ends and the motion of the rocker arm alternately brings the north and south poles of the magnet adjacent to the Hall-effect sensor 80. This varies the analog output voltage of the Hall-effect sensor 80 between a minimum and maximum.

FIG. 6 illustrates the drive mechanism with the rocker arm 62 and the pushbar 16 in the outwardly extended position. In this condition, the latchbolt 18 is extended. As can be seen in FIG. 6, the lower end of magnet 82 is directly opposite the Hall-effect sensor 80 and in the preferred orientation, the Hall-effect sensor 80 produces a minimum output voltage (see FIG. 10).

The Hall-effect sensor is connected to the controller and its output voltage is supplied to the controller as a sensor output signal. In the preferred design, the controller includes an integrated analog to digital converter so that the output signal may be monitored by the controller digitally.

In a preferred embodiment, the controller is configured to automatically detect the orientation of the magnet 82 during initial power-up. If the magnet 82 is installed in the preferred orientation, the output voltage from the Hall-effect sensor will be minimum at startup and will increase as the output shaft 32 is retracted. If magnet 82 is installed in the reverse orientation, the output voltage from the Hall-effect sensor will be maximum at startup and will decrease as the output shaft 32 is retracted. An initial startup routine is preferably used to detect the orientation of the magnet and adjust therefor.

Figure 10:
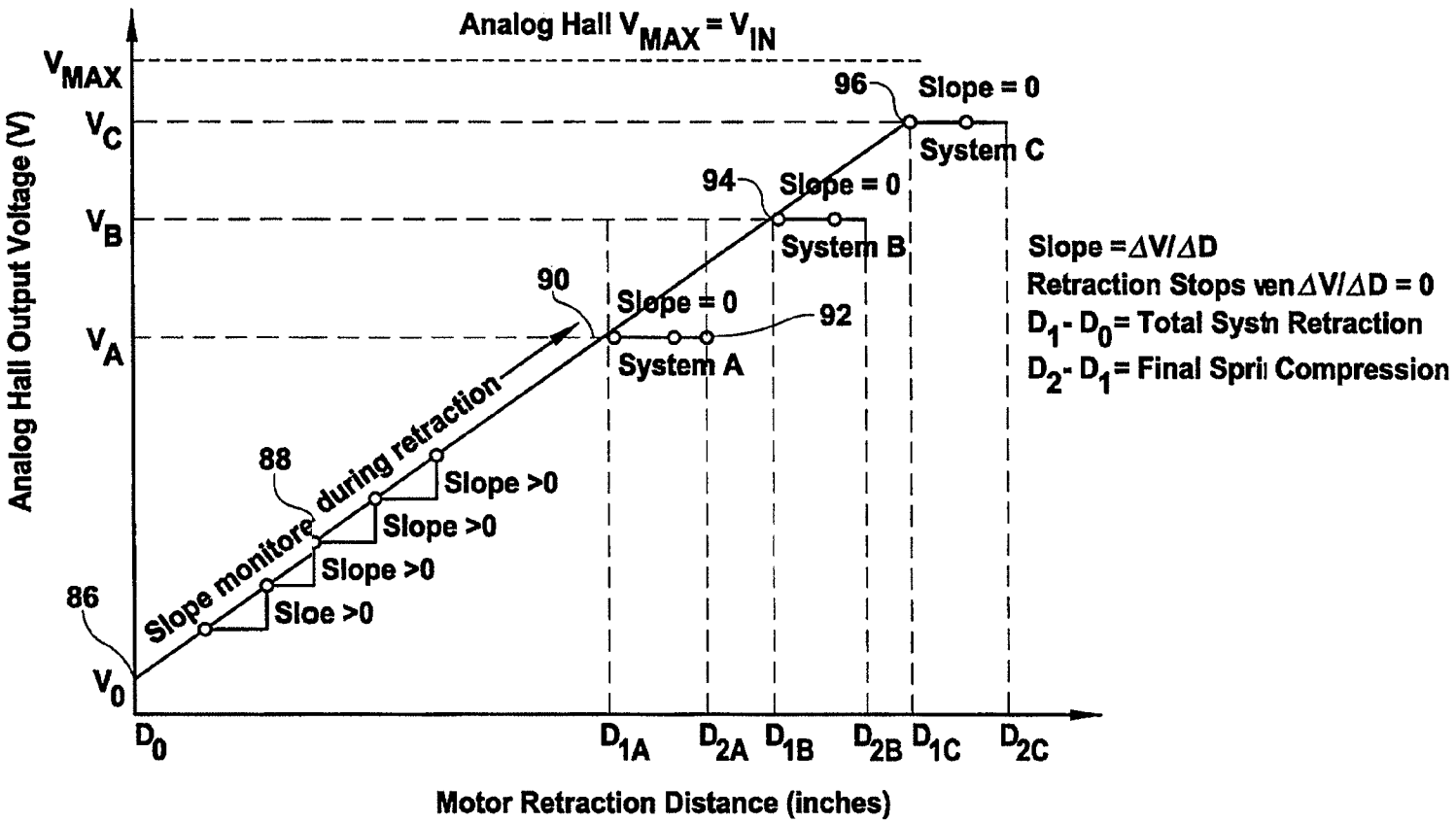
FIG. 10 is a graph showing electrical output of the position sensor as a function of retraction distance of the pushbar. Because the drive mechanism illustrated may be used in different embodiments of the invention, three different output curves for different embodiments are shown.

FIG. 10 provides a graph of the analog output voltage V from the Hall-effect sensor (vertical axis) as a function of motor retraction distance D (horizontal axis). The "motor retraction distance" corresponds to the location of the end of the output shaft 32. This location is known to the controller by the number of pulses sent by the controller to the stepping motor 30.

FIG. 6 corresponds to motor retraction distance $D_0$ and the analog voltage $V_0$ at point 86 in FIG. 10. As the controller retracts the output shaft 32, the entire spring carriage 38 initially moves towards the stepping motor 30. This can be seen in FIG. 7, which shows an intermediate position for the spring carriage and the output shaft corresponding to point 88 in FIG. 10. FIG. 7 and point 88 are midway between the initial position of FIG. 6 (point 86 in FIG. 10) and the inflection point 90 (position $D_{1A}$ voltage $V_A$) in the graph of FIG. 10.

As can be seen in FIG. 7, the rocker arm 62 has rotated around the lower rocker arm pivot pin 66 and the magnet 82 has moved relative to the Hall-effect sensor 80 to produce the new output voltage. As the magnet 82 and rocker arm move, the magnetic field in the vicinity of the Hall-effect sensor changes. In the preferred magnetic orientation, the output voltage continuously increases at a relatively constant rate as the output shaft moves at a constant rate. This can be seen as a relatively constant slope of the graph in FIG. 10 from point 86 to the inflection point 88.

The controller monitors the changing output signal from the sensor and it can calculate the distance that the output shaft 32 of the linear actuator has retracted. From these, the controller can determine the slope of the changing voltage from the sensor and detect changes therein.

As the output shaft is retracted, the spring carriage and spring 40 initially move as a unit with the shaft. During this initial motion, the spring 40 remains at its initial compression with the spring pin 42 at the far end of the spring pin slot 43, 45. As described above, also during this initial motion (from point 86 to 88 in FIG. 10) the magnet 82 smoothly passes by the adjacent Hall-effect sensor producing a smoothly and continuously changing voltage having the relatively constant slope in FIG. 10.

The controller continuously monitors this output signal, and in the preferred design it monitors the slope of this signal. Provided that the spring carriage, the rocker arm and the pushbar are unobstructed, the slope of this signal will be relatively unchanged as the retraction continues under the control of the controller 24.

When the pushbar reaches its normal mechanical limit the pushbar 16 will stop moving, as will the rocker arm 62, the linkage 64, the spring carriage pin 54 and the spring carriage 38. The output shaft 32, however, will continue to move. This motion compresses the spring 40 further as the spring pin 42 slides in the spring pin slots 43, 45.

This additional compression can be seen in FIG. 8, which corresponds to position $D_{2A}$ and point 92 in FIG. 10. In this position, the spring pin 42 has moved relative to the confines of the spring pin slots 43, 45 towards the motor 30. This compresses the spring 40 even further between the spring pin 42 and wall 44 of the spring carriage.

Referring to FIG. 10, because the rocker arm 62 and magnet 82 have stopped moving, the voltage V has stopped changing at the voltage level $V_A$ which is the same for both points 90 and 92. The output signal from the sensor remains relatively unchanged, as the motor retracts the output shaft 32 from position $D_{1A}$ to $D_{2A}$. During this second region of operation, the slope of the graph is zero, while in the first region of operation (from $D_0$ to $D_{1A}$) the slope was positive. This change in slope forms an inflection point at point 90 that is detected by the controller. The inflection point 90 corresponds to the point at which the moving door hardware component has reached a stop or has been obstructed.

The point marked with reference no. 92 corresponds to the point of maximum retraction of the shaft 32 by the motor 30. From $D_0$ to $D_{1A}$ the spring carriage and rocker arm moved continuously. In the region from $D_{1A}$ to $D_{2A}$, the output shaft 32 was moving and the spring 40 was being additionally compressed, but the rocker arm 62 remained stationary.

The controller detects the inflection point 90 by identifying a transition in the voltage from a continuously changing output signal between $D_0$ and $D_{1A}$ to a constant output signal between $D_{1A}$ to $D_{2A}$. This detection is preferably accomplished by detecting the slope of the signal, but other means of detecting the inflection point may also be used by those with skill in the art.

Once the inflection point 90 has been identified, the controller stops retraction. In the preferred embodiment, each operation cycle of the drive mechanism produces a parameter corresponding to detection of the inflection point. This parameter may be the number of pulses sent to the stepping motor of the linear actuator, or the voltage of the inflection point or a similar parameter.

In the preferred design, this parameter is stored for use in the next operating cycle. During the next operating cycle, the new parameter can be compared to the previously stored parameter. During normal operation, the new parameter will be close to or the same as the previous parameter.

In the most highly preferred design, a predetermined difference between new and old parameters is selected to set the boundary for when the controller will consider the system to be operating normally. When the new parameter differs from the previously stored parameter by more than this predetermined difference, for example, as will occur when the mechanism has been blocked, the preferred design for the controller will automatically reset and recycle the device by releasing the driver and spring carriage and attempting to retract again.

For example, if the mechanism is blocked at a partial retraction point corresponding to FIG. 7 and point 88 in FIG. 10, the output voltage will stop increasing at point 88 and instead will remain constant. An inflection point for this blockage condition will be identified at point 88. The controller will be able to detect this change by comparing the new parameter to the parameter stored from the previous cycle.

The stored parameter may be a parameter stored accordingly to the voltage reached or a parameter stored according to the distance moved by the output shaft 32 or a parameter corresponding to motion by the door hardware component itself.

In another aspect of the preferred design, when power is initially applied to the controller, the controller begins a self-adjusting calibration routine in which multiple cycles are performed by retracting the mechanism until the inflection point is identified. As indicated above, one step in this calibration routine may be identifying the orientation of the magnet. During the calibration routine several operating cycles may be repeated, each time releasing the system to return to the outwardly extended position after reaching the inflection point. This is repeated until a normal operating parameter has been identified corresponding to a normal operating cycle. In this way, the drive mechanism locates the normal inflection point which corresponds to the normal mechanical limits of operation.

FIG. 10 illustrates how the same drive mechanism may be used in different products by indicating that the inflection point may be located at points $D_{1A}$, $D_{1B}$, or $D_{1C}$ corresponding to three different mechanical designs identified as System A, System B, and System C. In each of these different system designs, the same drive mechanism may be used without any change to the controller. In each case, the controller will identify the correct inflection point corresponding to the mechanical limit of motion for that product during the initial calibration routine.

For System A inflection point 90 will be found and a normal operating parameter stored that corresponds to that point. For System B inflection point 94 will be found. As System B moves its door hardware component, the output signal will remain at the same relatively constant slope until point 94 is reached. System C has the inflection point 96. The self-adjusting calibration routine may be initiated each time power is applied or it may be started with a separate control switch activated at the time of installation.

If motion of the door hardware is temporarily blocked, the blockage can be identified as a significant change in the location of the inflection point. Comparison to the normal location of the inflection point allows the controller to identify the change and immediately recycle the system. This avoids the difficulty of having to send a repair technician to reset the system. Temporary blockages and errors are immediately and automatically identified and corrected.

Another advantage to this system is that the system automatically and continuously readjusts to changes in the location of the inflection point due to normal wear. Small changes in the retraction distance and the location of the inflection point are less than the predetermined amount needed to trigger the reset/recycle operation described above. Small changes due to wear are automatically compensated for in the initial automatic calibration and in the cycle-by-cycle storage of the parameter corresponding to the location of the inflection point.

The design of the preferred embodiment allows the drive mechanism to be used in different types of door hardware having different mechanical stops and different retraction distances. No change is required to the electronics of the controller because the automatic initial calibration compensates for differences in the retraction distance due to design differences. The initial calibration routine also compensates for differences in the retraction distance due to external structure such as in installations where the retraction distance is limited by the door or the doorframe.

Those of skill in the art will recognize that identification of the inflection point by the controller requires that the driver continue retracting past the inflection point and thereby compress the spring 40 beyond the initial compression. However, it is often desirable to minimize this additional compression. Accordingly, in one aspect of the preferred embodiment of the invention, when the controller identifies the inflection point, the controller reverses the driver direction after the inflection point has been identified. This reversal extends the output shaft 32 and reduces the compression of spring 40. In the preferred design, the additional compression may be as little as 0.020"-0.050" (0.5 mm-1.25 mm).

An advantage of this reversal is that the driver can apply a very high compression force to spring 40 before reversing and returning to a low compression force to hold position. The high compression force ensures that the pushbar actually reaches a true mechanical limit and is not merely temporarily stopped due to a point of higher resistance in the retraction. Any minor increase in friction will be overcome as the spring 40 is compressed. The rocker arm will jump suddenly as the sticking point is passed. The controller will detect this movement from the sensor and continue beyond the true inflection point before returning close to it and entering a holding state.

In the preferred design, the spring 40 is selected so that it is capable of exerting a force greater than the force that the stepping motor is capable of exerting.

Another feature of the present design relates to the operation of the linear driver when the system is released to return the pushbar to the extended position. As described above, the controller is capable of operating the stepping motor by driving it in either direction. The stepping motor may also be held in a locked position or power may be removed completely, which allows the stepping motor to rotate freely. In the latter freewheeling case, the output shaft 32 will move under the influence of pushbar biasing spring 78 and the pushbar will return to the outward position.

In the design of the pushbar exit device shown, the pushbar biasing spring 78 is capable of returning the pushbar to the extended position with great force. If power is completely removed from the linear actuator when spring 78 is full compressed, the return force produces an audible click or impact sound, which can be objectionable.

In the preferred design, instead of simply releasing the stepping motor to freewheel, the controller uses a residue of remaining power to drive the stepping motor in the reverse direction. The residue of remaining power is the power that is typically stored in filter power capacitors. The filter power capacitors are conventionally located in the supply power for the motor 30. This reverse drive motion is slower than the springs 78 and 40 would move the system if the motor 30 was allowed to freewheel. This provides a controlled soft-release for the drive mechanism, which eliminates the objectionable sound produced when the pushbar is released.

Figure 9:
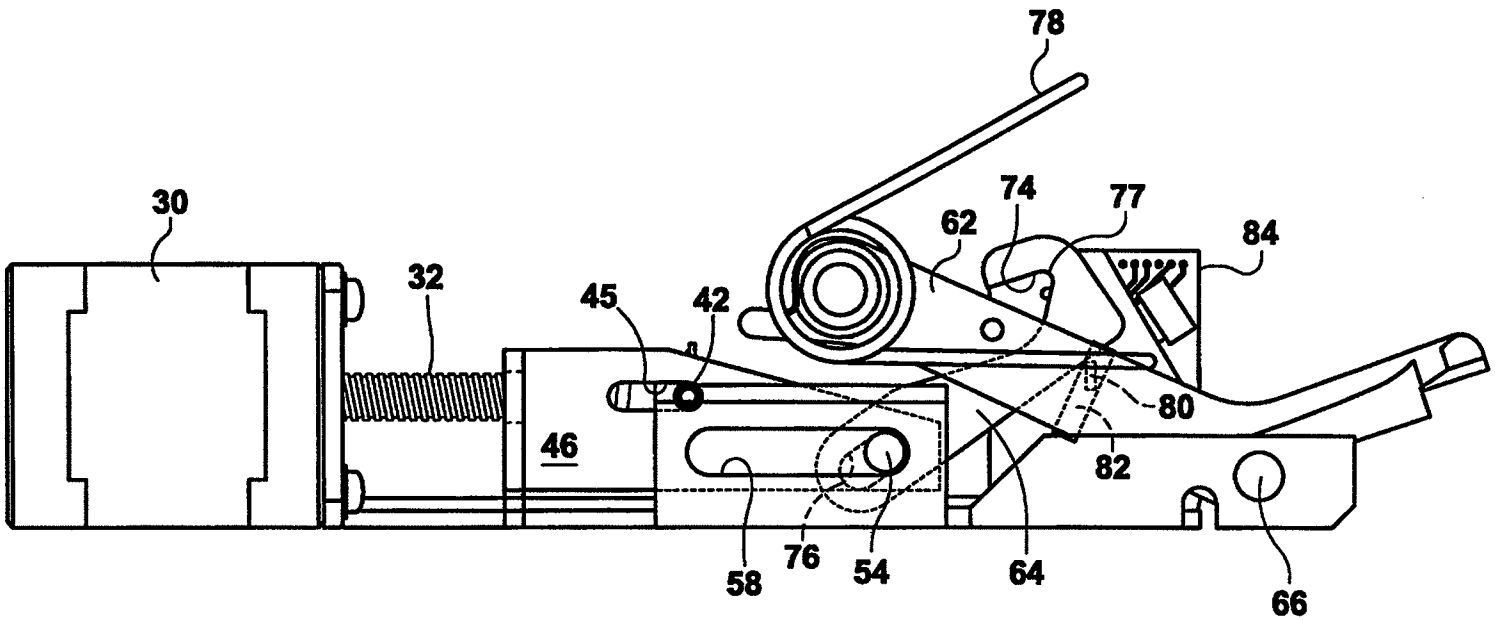
FIG. 9 is a side elevational view of the drive mechanism assembly corresponding to FIGS. 6-8 except that the drive mechanism is shown in the mechanically retracted state with the linear actuator still electrically extended as in FIG. 6. The pushbar of FIG. 1 has been manually pressed inward towards the door to retract the latchbolt and open the door while the linear actuator remains extended.

FIG. 9 is provided to illustrate the relative positions of the drive mechanism and the rocker arm when the pushbar 16 is manually pushed to the retracted position. As can be seen, the motor shaft 32 remains in the extended position as the rocker arm and pushbar are manually operated. The hook opening 74 and opening 76 in the ends of the linkage 64 permit this mechanical motion independent of the linear actuator when the linear actuator is extended.

FIG. 9 shows how the spring carriage pin 54 has moved to the opposite end of opening 76 and rocker arm connection pin 77 has moved relative to hook opening 74 to permit the manual operation independent of the motion of the linear actuator's output shaft 32.

As will be understood from the description above, when the controller 24 operates stepping motor 30, a threaded nut within the stepping motor (not shown) spins relative to the threaded output shaft 32 and extends or retracts that shaft to correspondingly slide the spring carriage 38. The spring carriage pin 54 moves with the spring carriage within the limits set by spring carriage slots 56 and 58. FIGS. 3, 4, 6 and 9 illustrate the shaft 32 in the fully extended position. As the shaft is retracted, the spring carriage pin 54 moves towards the motor 30 and pulls linkage 64 which pulls on the rocker arm connection pin 77 to pivot the rocker arm 62 around the lower rocker arm pivot pin 66. This draws the pushbar 16 towards the retracted position and correspondingly retracts the latchbolt 18.

In still another aspect of the invention, the controller may continuously monitor the sensor even when the driver is not moving and after the inflection point has been identified. In the normal condition, after the inflection point has been reached, the moving component of the door hardware will be up against a hard stop and will not move until released by the controller. However, it is possible for the mechanism to appear to be against a hard stop when it is not, or for a sudden impact to cause motion away from a hard stop.

Regardless of the cause, if the controller senses motion of the moving component when it should be motionless, the preferred design releases the moving component and recycles to retract the pushbar again. Sensed motion in the holding state can be the result of a strong impact, as may occur when an open door is released in a windstorm and slams shut. Impacts like this may cause the door hardware to bounce away from a stop or a stepping motor to release even when it is being commanded to remain in the holding state by the controller.

Sensed motion of the door hardware component when the stepping motor is in the holding state may also indicate that the pushbar was temporarily blocked during retraction, but has now been released and is able to move within limits. This can occur even in the preferred embodiment that compares the location of the inflection point for each retraction cycle to the inflection point location of the previous cycle.

Still another aspect of the preferred design of the controller is that the controller initially operates the driver to remove slack and ensure the door hardware component has begun to move, prior to attempting to identify the inflection point. A fixed number of pulses or a fixed distance may be used to ensure that initial slack in the system is removed and initial starting friction is overcome before the controller attempts to detect from the sensor that the door hardware component has stopped moving while the driver is still retracting.

Another aspect of the controller relates to the detection method for the inflection point. In the most highly preferred implementation, the controller monitors slope of the sensor output signal by using an average method. Multiple pulses may be sent to the stepping motor, and each pulse may correspond to a relatively tiny motion of the output shaft and a corresponding relatively tiny motion of the rocker arm and magnet 82 relative to the sensor 80.

The inflection point may be identified by using an average slope of Hall-effect sensor output voltage over multiple steps of the stepping motor. As additional steps are taken, the averaging window is moved. The preferred design uses a boxcar (windowed) averaging method with vertical sides on the window, although other averaging methods may also be effectively used.

The preferred design of this invention operates the spring 40 in compression, however it may also be designed with the spring operating in tension.

While the present invention has been particularly described, in conjunction with a specific preferred embodiment, it is evident that many alternatives, modifications, and variations will be apparent to those skilled in the art in light of the foregoing description.

It is therefore contemplated that the appended claims will embrace any such alternatives, modifications, and variations as falling within the true scope and spirit of the present invention.

Thus, having described the invention, what is claimed is:

The invention claimed is:

1. A drive mechanism for door hardware comprising:

a driver operatively connected through a spring to a door hardware component to move the door hardware component by driving the spring;

a controller electrically connected to the driver to control the driver and move the door hardware component;

a sensor connected to the controller and mounted to detect motion of the door hardware component; and the spring connected between the driver and the door hardware component allowing the driver to move without moving the door hardware component when motion of the door hardware component is blocked;

the controller monitoring the sensor and operating the driver to move the door hardware component at least until the sensor indicates that motion of the door hardware component by the driver has stopped.

2. The drive mechanism for door hardware according to claim 1 further including a magnet and wherein the sensor is a Hall effect sensor, the sensor detecting motion of the door hardware component by detecting relative motion between the Hall effect sensor and the magnet.

3. The drive mechanism for door hardware according to claim 2 wherein the magnet is mounted on the door hardware component.

4. The drive mechanism for door hardware according to claim 2 further including a circuit board and wherein:

the magnet is mounted on the door hardware component; and the Hall effect sensor is mounted on the circuit board.

5. The drive mechanism for door hardware according to claim 1 wherein the door hardware component is a rocker arm for a pushbar exit device.

6. The drive mechanism for door hardware according to claim 1 wherein the controller initially operates the driver to ensure the door hardware component begins to move prior to determining from the sensor when motion of the door hardware component has stopped.

7. The drive mechanism for door hardware according to claim 1 wherein:

the driver has a maximum driver force that can be exerted by the driver to the spring;

the spring has a maximum spring force that can be exerted by the spring when the spring is fully compressed; and the maximum spring force is greater than the maximum driver force.

8. The drive mechanism for door hardware according to claim 1 wherein:

the sensor provides a substantially continuously changing sensor output signal as the door hardware component is driven by the driver through the spring;

the sensor provides a substantially unchanging sensor output signal when the door hardware component stops moving, even when the driver continues to move; and the controller monitors the sensor output signal to detect an inflection point indicating a transition from the substantially continuously changing sensor output signal to the substantially unchanging sensor output signal.

9. The drive mechanism for door hardware according to claim 8 wherein the controller operates the driver to compress the spring a predetermined amount after the controller detects the inflection point.

10. The drive mechanism for door hardware according to claim 9 wherein the predetermined amount of spring compression is selected to minimize the spring compression while also ensuring that the door hardware component has reached a desired location corresponding to the inflection point.

11. The drive mechanism for door hardware according to claim 8 wherein the controller operates the driver to compress the spring after the controller detects the inflection point and then operates the driver in a reverse direction to reduce compression of the spring.

12. The drive mechanism for door hardware according to claim 8 wherein:

the controller stores a first parameter corresponding to a first detection of the inflection point for a first operating cycle of the drive mechanism;

the controller compares the stored first parameter to a second parameter corresponding to a second detection of the inflection point for a second operating cycle of the drive mechanism; and the controller initiates a third operating cycle to recycle the drive mechanism when the second parameter differs from the stored first parameter by more than a predetermined difference.

13. The drive mechanism for door hardware according to claim 12 wherein the stored parameter for each operating cycle corresponds to a distance the controller has moved the door hardware component before detecting the inflection point.

14. The drive mechanism for door hardware according to claim 8 wherein the controller includes a self adjusting calibration routine comprising repeating a plurality of operating cycles, detecting an inflection point for each cycle and storing a parameter corresponding to a normal operating cycle and the inflection point therefor.

15. The drive mechanism for door hardware according to claim 14 wherein the controller enters the self-adjusting calibration routine when power is initially applied thereto.

16. The drive mechanism for door hardware according to claim 8 wherein the controller detects the inflection point by calculating a slope for the changing sensor output signal and detecting a change in the calculated slope.

17. The drive mechanism for door hardware according to claim 16 wherein the controller calculates the slope of the changing sensor output signal by using a sliding window including multiple detections of the changing sensor output signal.

18. The drive mechanism for door hardware according to claim 1 further including a spring carriage, and wherein:

the spring is mounted in the spring carriage; and the spring carriage is slidably mounted to the drive mechanism.

19. The drive mechanism for door hardware according to claim 18 wherein the spring is held in a compressed state inside the spring carriage.

20. The drive mechanism for door hardware according to claim 18 wherein:

the spring is held in a compressed state inside the spring carriage with a first end of the spring fixed relative to the spring carriage and a second end of the spring movable relative to the spring carriage;

the spring carriage is adapted for connection to the door hardware component; and the driver is connected to the second end of the spring.

21. The drive mechanism for door hardware according to claim 20 further including a spring pin connected to the second end of the spring, and wherein:

the spring carriage includes opposed sides, each side having a corresponding spring pin slot; and the spring pin extends between the opposed sides and slides within the spring pin slots as the spring is compressed.

22. The drive mechanism for door hardware according to claim 18 wherein:

the drive mechanism includes a support base having a pair of upstanding flanges; and the flanges are spaced apart to receive the spring carriage and allow the spring carriage to slide therebetween.

23. The drive mechanism for door hardware according to claim 22 further including a spring carriage pin and wherein;

each of the flanges has a corresponding spring carriage slot formed therein; and the spring carriage pin moves with the spring carriage and slides in the spring carriage slots.

24. The drive mechanism for door hardware according to claim 23 wherein the spring carriage pin is connected to the door hardware component.

25. The drive mechanism for door hardware according to claim 24 wherein the door hardware component is a rocker arm for a pushbar exit device and the rocker arm is connected to the spring carriage pin with a linkage.

26. The drive mechanism for door hardware according to claim 1 wherein the driver includes a shaft extending through the spring.

27. The drive mechanism for door hardware according to claim 1 wherein the door hardware component is biased towards a first position and the controller operates the driver to move the door hardware component away from the first position towards a second position.

28. The drive mechanism for door hardware according to claim 27 wherein the controller removes power from the driver to permit the door hardware component to return from the second position to the first position.

29. The drive mechanism for door hardware according to claim 28 wherein the controller operates the driver to move the door hardware component away from the second position towards the first position as the door hardware component returns from the second position to the first position.

30. The drive mechanism for door hardware according to claim 1 wherein the drive mechanism is self-adjusting each time power is applied to the controller.

31. The drive mechanism for door hardware according to claim 1 wherein the sensor provides a sensor output signal to the controller and the controller monitors a slope of the sensor output signal to detect that motion of the door hardware component has stopped.

32. The drive mechanism for door hardware according to claim 1 wherein the sensor includes a magnet and the controller initially detects an orientation of the magnet.

* * * * *